United States Patent [19]

Sansome et al.

[11] Patent Number: 4,748,835

[45] **Date of Patent: * Jun. 7, 1988**

[54] PLUG DRAWING OF TUBES AND OTHER HOLLOW ITEMS

[75] Inventors: Dennis H. Sansome, West Midlands; Gerald M. Jones, Bewdley, both of England

[73] Assignee: National Research Development Corporation, London, England

[ * ] Notice: The portion of the term of this patent subsequent to Apr. 7, 2004 has been disclaimed.

[21] Appl. No.: 76,752

[22] Filed: Jul. 23, 1987

Related U.S. Application Data

[62] Division of Ser. No. 820,728, Jan. 21, 1986, Pat. No. 4,697,447.

[30] Foreign Application Priority Data

Jan. 22, 1985 [GB] United Kingdom ..... 8501573

[51] Int. Cl.[4] ..... B21C 9/00; B21C 1/24

[52] U.S. Cl. ..... 72/44; 72/283

[58] Field of Search ..... 72/43–45, 72/41, 283, 274, 209

[56] References Cited

U.S. PATENT DOCUMENTS

| | | | |
|---|---|---|---|
| 2,355,734 | 8/1944 | Katz | 72/45 |
| 2,363,476 | 11/1944 | Bannister | 72/97 |
| 3,596,491 | 8/1971 | Cress et al. | 72/283 |
| 4,057,992 | 11/1977 | Willimzik | 72/43 |
| 4,655,065 | 4/1987 | Sansome et al. | 72/283 |

FOREIGN PATENT DOCUMENTS

| | | | |
|---|---|---|---|
| 2127177 | 10/1972 | France | 72/43 |
| 298400 | 3/1971 | U.S.S.R. | 72/283 |
| 1007860 | 3/1983 | U.S.S.R. | 72/283 |

*Primary Examiner*—Daniel C. Crane

*Attorney, Agent, or Firm*—Cushman, Darby & Cushman

[57] ABSTRACT

A variable-geometry plug for use in the plug drawing of tube or other elongated hollow stock. The plug comprises first and second coaxial and relatively-movable parts which co-operate with a deformable annular sealing ring. With the two parts so disposed that the ring is relaxed, the plug can be inserted easily into the undrawn stock. In use, the two parts are caused to move relative to each other, so deforming the ring that it seals an annular clearance between the plug and the undrawn stock. If lubricant is then provided at the upstream face of the seal, the movement of the stock over the seal then tends to draw that lubricant forward across the seal by hydrodynamic action, so tending to fill the clearance with that lubricant at an enhanced pressure. Plugs are described in which this hydrodynamic pressurization is augmented by fluid under pressure supplied direct to the clearance through conduits including passages formed through the body of the plug. Plugs connected to solid bars and flexible leads, and also truly "floating" plugs no such connection, are described.

2 Claims, 2 Drawing Sheets

PLUG DRAWING OF TUBES AND OTHER HOLLOW ITEMS

Figure 1:
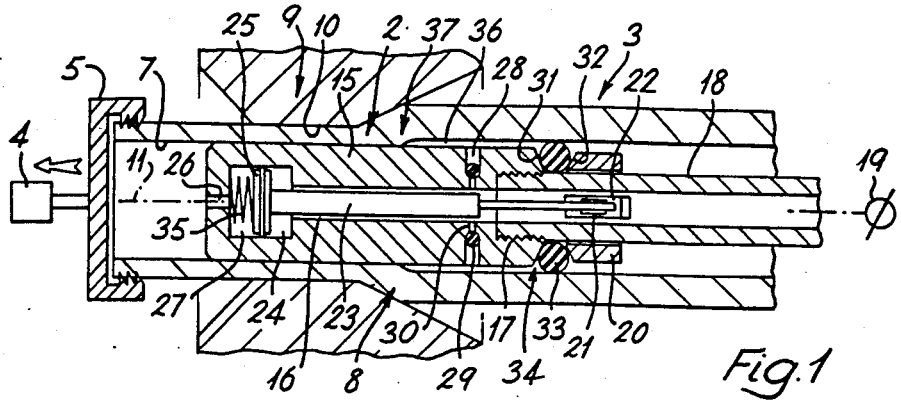

This is a division of application Ser. No. 820,728 filed Jan. 21, 1986, now U.S. Pat. No. 4,697,447, issued Oct. 6, 1987.

This invention relates to the plug drawing of tubes and other elongated stock of hollow section. It includes within its scope not only the known type of apparatus and process in which the plug is mounted on one end of a rod or bar, long enough to pass through the entire length of the undrawn stock so that the other end of the bar can be attached to fixed structure. It includes also the alternative known process and apparatus in which there is no such supporting bar and the plug itself, which is relatively short in length, is so shaped that the reaction between it and the inner wall of the stock is sufficient to hold it in a stable manner within the drawing die as drawing proceeds, the final clearance between plug and die as usual defining the section of the drawn tube; such a plug is commonly known as a "floating plug".

Plug drawing has been known and practised for a very long time, and the need has also long been appreciated for a copious supply of a suitable lubricant to be present at all times adjacent to the "nip" where the inner surface of the undrawn tube first converges upon and makes contact with the surface of the plug. Without such a supply of lubricant it is unlikely that a continuous, thin film of lubricant will be set up between the plug and the tube over the area of working contact between them that lies downstream of the nip, and without such a continuous film the final inner surface of the drawn tube as it emerges from the region of contact may be imperfect, which can lead to imperfections in the outer surface also. Alternatively, such high friction forces may be generated that the tube will fracture.

Providing this copious supply of lubricant to the plug presents obvious difficulties however, bearing in mind that at least at the start of a drawing operation the nip will be a long way from the trailing end of the undrawn tube and will be accessible only through that end. One customary way of providing it has been simply to coat the entire inner surface of the tube with an excess of lubricant in grease-like form prior to drawing and, if this has not been sufficient, to enhance the lubricant-supporting capacity of the surface by subjecting it to grit-blasting, acid-pickling or some other surface treatment prior to applying the lubricant.

More recently, as taught in the specification of copending patent application No. 8,411,289 filed May 2, 1984, it has been proposed to promote the more effective supply of lubricant to the nip by providing a means to enhance the pressure to which any fluid adjacent that nip will be subjected while the drawing proceeds. The plugs described in that specification are so shaped as to define an annular cavity, of particular shape and dimensions, between the plug and that part of the bore of the undrawn tube that lies immediately upstream of the nip. The extreme upstream end of that cavity is not sealed, because there is still an annular clearance between plug and bore, but the clearance is slight and the plug surface is so shaped that the movement of the tube over the plug during drawing tends by hydrodynamic action to exert a positive forward force upon lubricant carried forward by the bore surface as it approaces this clearance, so drawing that lubricant through the clearance into the annular space so as to raise the fluid pressure in that space to a value above ambient.

While it has been clearly demonstrated that lubrication at the nip, and with it the inner surface finish of the product, can be significantly improved using plugs as just described, they have an obvious limitation in that the vital hydrodynamic effect depends on there being a significant relative velocity between the tube and the plug, and/or an adequately viscous lubricant, and/or a small annular clearance between plug and undrawn tube. It may therefore be difficult, for example, to insert the plug into the undrawn tube prior to drawing, particularly in the typical case in which the latter is not perfectly straight and its internal section is not perfectly regular. Even greater difficulty could be expected if one attempted to insert, down the bore of an undrawn tube, a plug of such diameter at its tail end that it only fitted into the bore of the tube with interference, instead of leaving a clearance however small in between.

The present invention arises from appreciating the possibility of designing a plug of variable geometry, capable in one of those geometries of being inserted into the undrawn tube or other hollow stock with ease, and then in another geometry of making a positive seal at its tail end against the tube bore, so positively closing the annular space or cavity just upstream of the nip and thus simplifying the process of subjecting any fluid lubricant within that space to above ambient pressure, that is to say pressure higher than that existing rearward of the plug in the bore of the undrawn stock.

According to the invention a plug for use in the plug drawing of tube or other elongated stock of hollow section comprises first and second parts movable relatively to each other in a direction parallel to the drawing axis, and a deformable annular sealing member capable in its undeformed state of easy insertion into the undrawn tube, and in its deformed state of sealing the annular clearance between the undrawn tube and the upstream end of the plug as drawing takes place.

Relative movement of the two parts in one sense serves to deform the sealing member, relative movement in the opposite sense then allows it to relax to its undeformed state.

The relative motion of the two parts in the first sense may create a wedge action upon the sealing member, so that its outer diameter increases.

The plug may include a third plug part, which cooperates with the other two parts and which, as they move relatively to each other in the first sense, bears outwardly against the radially-inner edge of the sealing member.

The plug may be adapted for connection at its upstream end to a hollow plug-supporting bar through which lubricating fluid under pressure may be supplied in use. It may also include internal conduits through which the fluid received from the hollow plug bar may pass to a point of use. The internal conduits may have outlets so located as to deliver the fluid, during use, to the enclosed space of annular section between the plug and the undrawn tube, this space being bounded at its forward end where the inner wall of the tube makes contact with the plug in the course of drawing, and at its upstream end by the deformed sealing member.

Connection of the internal conduits to the supply of lubricating fluid under pressure may tend to move the two plug parts so that they deform the sealing member.

The invention also includes a method of plug drawing a tube or other elongated stock of hollow section, using a plug of variable geometry and including a deformable annular sealing member, in which in use the geometry varies and causes the sealing member to deform whereby it closes the rearward end of an annular clearance between the plug and the undrawn part of the stock, so as to permit that clearance to be filled with fluid at above ambient pressure.

Figure 3:
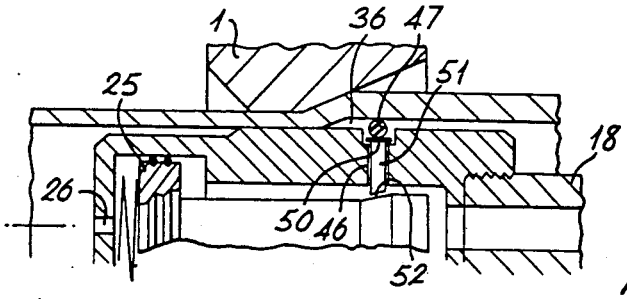
Figure 4:
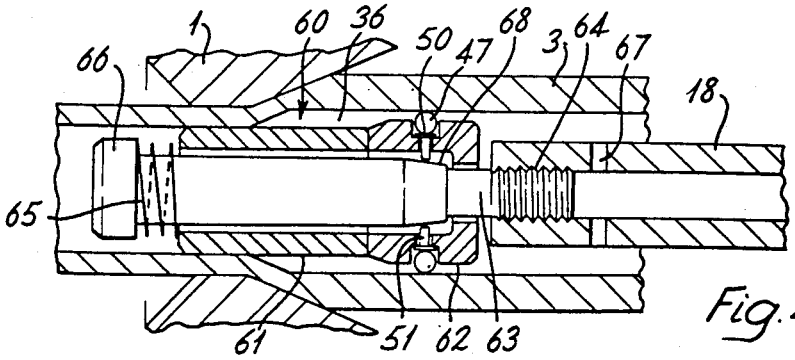
Figure 5:
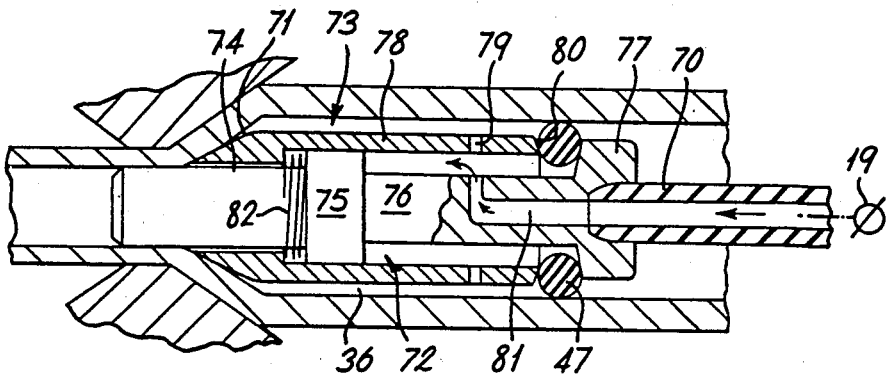
Figure 6:
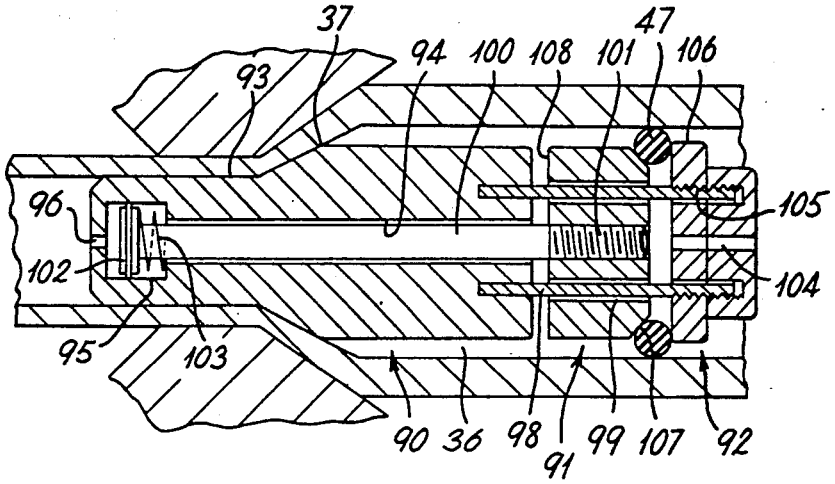

The invention is also defined by the claims and will now be described, by way of example, with reference to the accompanying diagrammatic drawings, in which:

FIGS. 1 to 4 are axial sections through four different plugs, all bar-supported, and FIGS. 5 and 6 are sections through two different floating plugs.

All the Figures show a die 1, and a plug indicated generally at 2, between which a tube 3 is to be drawn by a drawing engine. Such an engine 4, attached to the forward end of the tube 3 by jaws 5, is shown in outline in FIG. 1 only. Reference 6 represents the undrawn tube, reference 7 the drawn tube, and reference 8 represents what is commonly known as the "deformation zone" in which the section of the tube changes from undrawn to drawn. Immediately downstream of zone 8, the shape of the drawn tube 7 stablises as it passes through a zone 9, of finite length, with its inner wall in contact with the substantially cylindrical wall of the plug and with its outer wall in contact with the confronting and substantially cylindrical wall 10 of that part of the die that is known as the land. Reference 11 represents the drawing axis.

The plug 2 of FIG. 1 comprises a hollow forward part 15, formed with an internal bore 16 and screw-threaded at 17 to receive a hollow plug bar 18, the remote end of which is connected to a source 19 of lubricant under pressure. The plug also comprises a ring-shaped rearward part 20, which makes a close but sliding fit over the bar 18 and is mounted on radial spokes 21 which pass through slots 22 formed in the wall of the bar. Within the bar the spokes 21 radiate from and are fixed to one end of a rod 23 which lies with clearance within bore 16. Towards its downstream end, this bore widens to form a cylinder 24 in which fits a piston 25 carried by the other end of rod 23. A drilling 26 ensures that pressure in the part 27 of cylinder 24 to the downstream side of piston 25 is at the same pressure, typically ambient pressure, as exists within the bore of the drawn tube. A circumferential groove 28, containing an "O"-ring seal 29, is formed around the outer surface of the forward part 15 of the plug and communicates, by way of drillings 30, with the bore 16. Forward and rearward parts 15 and 20 are separated and present confronting bevelled faces 31 and 32, and an "O"-ring seal 33 is located in a groove 34 of which the faces 31, 32 form the sides, and the outer surface of bar 18 forms the base.

In operation, before the plug 2 is inserted into the undrawn tube, a spring 35 acts on piston 25 so as to urge part 20 to the right (as viewed in FIG. 1), so widening the groove 34, allowing ring 33 to take up its shape of least radius. It therefore offers least interference and impediment when the plug 2 is first inserted into the undrawn tube, the leading end of which will then in accordance with known practice be collapsed, fed through the die 1, gripped by jaws 5 and pulled by engine 4 until the plug lies within the die as shown and drawing may commence. If now source 19 is energised to deliver lubricant at adequate pressure, the close sliding fit of part 20 over bar 18 minimises lubricant escape from the bore of the bar through slots 22. Instead the fluid acts in two main ways. Firstly it acts on the upstream face of piston 25 to move that piston to the left, compressing the light spring 35 and also moving part 20 to the left so as to narrow the groove 34 and thus expand the ring 33 radially so that it makes a sealing fit against both the inner wall of the undrawn tube 6 and the outer wall of bar 18. Secondly the pressure causes the "O"-ring 29 to yield so that lubricant under pressure passes by way of drillings 30 and groove 28 to enter the annular space 36 between the undrawn tube and the forward part 15 of the plug. This space is now totally enclosed because it is sealed at its upstream end by ring 33 and its downstream end by the nip 37 where the tube and plug meet at the deformation zone 8. Thus lubricant at adequate pressure is provided and maintained during use adjacent the nip, so helping to promote a continuous thin film of lubricant between the tube and the plug over the subsequent axial length where they are in contact and to diminish plug/tube friction during drawing.

Figure 2:
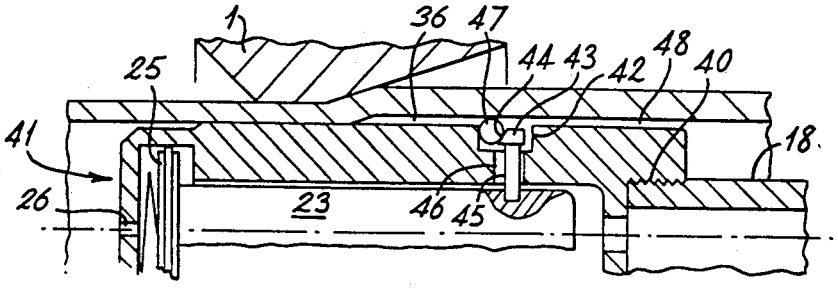

In the alternative construction of FIG. 2 the piston 25 acts similarly, but the bar 18 is now threaded at 40 to connect with a single plug member 41. A circumferential channel 42 is formed in the outer wall of that member and a ring 43, presenting a bevelled forward face 44, is mounted with clearance within that channel. Radial spokes 45, passing with clearance within corresponding drillings 46 in plug member 41, connect the ring 43 to piston rod 23. A flexible "O"-ring seal 47 is located between face 44 of ring 43 and the forward wall of channel 42. Plug member 41 is inserted into the undrawn tube 6, prior to the start of drawing, in exactly the same way as the plug 2 of FIG. 1. However when drawing begins, and lubricant at high pressure is fed to the interior of bar 18 by source 19, the forward motion of piston 25 and rod 23 expands "O"-ring 47 radially by squeezing it in the diminished space between face 44 and channel 42, so sealing the upstream end of space 36 by the reaction of the ring against the inner wall of the undrawn tube and against the channel walls. Lubricant under pressure will also reach channel 42 from the interior of bar 18 by way of drillings 46. However escape of that fluid into the bore of the undrawn tube by way of the narrow clearance 48 between the undrawn tube and the upstream end of member 41 will be inhibited by the forwardly-directed hydrodynamic force which will be experienced by any fluid within that clearance, by reason of the forward motion during drawing of the tube over the plug. Fluid therefore tends to force itself into the space 36 across the interface which ring 47 makes with the forward wall of channel 42, until the fluid pressure within space 36 reaches an equilibrium value sufficient to achieve the effects that have already been described for the apparatus of FIG. 1.

With the plug of FIG. 3, "O"-ring 47 is again located within a channel 42 and now rests upon a spiral spring 50, itself resting on the base of channel 42. Radially-aligned rods 51 are mounted to slide within drillings 46 so that the outward ends of of the rods bear against the inner circumference of the spring 50, while the radially-inward ends of the rods bear against an inclined surface 52 on rod 23. When drawing begins and lubricant under pressure is delivered to the interior of rod 18 by source 19, the radially-outward movement of rods 51 caused by the wedge action of surface 52 against their inner ends distorts the ring 47 so that it presses firmly against the inner wall of the tube and against the forward wall of channel 42, so sealing the upstream end of space 36 as before. Also as before, the forward hydrodynamic action exerted on any fluid within space 48 tends to cause the high pressure lubricant to force itself into the space 36 until the pressure reaches an equilibrium value as already explained.

FIG. 4 shows a fourth example of a plug with a parallel-sided outer surface, and where the tendency of the motion of the tube to draw the plug forward must therefore be resisted by attaching the plug to a bar 18. This plug is simpler than those already described in that it contains fewer parts. The hollow plug member 60 comprises a forward part 61, made of the hard metal that is customary for plugs, and brazed or otherwise connected at its rearward end to a sleeve 62 of suitable but cheaper material. A shaft 63, one end of which is screw-threaded at 64 into the hollow plug bar 18, fits with clearance within the hollow interior of plug 60. A coil spring 65, located between the forward end of plug part 61 and the rearward face of a boss 66 on shaft 63, tends to urge the shaft and the plug in opposite axial directions. "O"-ring 47, spiral spring 50 and rods 51 are arranged and function as in FIG. 3, but the surface 68 against which the inner ends of rods 51 bear is inclined in the opposite sense to the surface 52 of FIG. 3, because now it is the shaft 63 which is anchored by the plug bar while the surrounding plug parts 61, 62 are free to move, whereas in FIG. 3 it was the other way round. When drawing begins, the reaction of the moving tube on the forward part 61 of the plug member 60 causes that part to slide forward relative to the plug bar 18, so that the inner ends of rods 51 ride up on inclined surface 68. Simultaneously therefore, not only is "O"-ring 47 distorted to seal the rear end of space 36, but also the axial dimension and therefore the volume of that space is reduced, so raising the pressure of fluid already within the space, with the advantages already described. Complete filling of space 36 by lubricant prior to the expansion of "O"-ring 47 can be promoted in various ways, for example by coating the inner surface of the tube and/or the outer surface of plug member 60 copiously with lubricant, or by supplying lubricant to the region in excess from source 19 by way of the interior of bar 18 and of apertures 67 formed in the wall of the bar close to its forward end. By continuing to provide an excess of lubricant just upstream of "O"-ring 47 as drawing proceeds, the continuous depletion of the lubricant from space 36 as it escapes as a thin film through the nip 37 will tend to be replenished by lubricant carried forward into space 36 across the "O"-ring 47, due to the relative movement of the tube and the plug. Like its counterpart in previous Figures, spring 65 is of light strength and operates, when drawing ceases, to move the piston and surrounding plug relative to each other so as to collapse the "O"-ring 47 and so permit easy insertion of the plug into the next tube that is to be drawn.

The floating plug tool of FIG. 5 is attached not to a plug bar (such as item 18) by which it may be restrained from forward movement due to its reaction with the moving tube, but only to a non-rigid hollow tube 70 by which is connected in use to the source 19 by which lubricant under pressure is supplied. As is customary with floating plugs, this tool requires an inclined forward face 71 to bear against the tube wall adjacent the deformation zone 8, so as to experience a reverse axial thrust which balances any forward thrust and therefore holds the plug axially steady. The plug is essentially in two parts, an inner part 72 and an outer part 73. The inner part 72 conventionally comprises a cylindrical nose 74 which defines the inner diameter of the drawn tube and which is preceded by a guiding boss 75 and shaft 76 ending in a shoulder 77. The inclined face 71 is at the forward end of the outer part 73, and behind it lies a parallel-sided part 78 pierced by some drillings 79 and ending in an inclined rear face 80. Part 78 of the outer member forms the cylinder in which boss 75 moves, and high pressure lubricant enters that cylinder from flexible tube 70 by way of a passage 81 formed within shaft 76. A spring 82, which could be a Belleville washer for instance, is located between the boss 75 and the end wall of part 78. "O"-ring seal 47 is located between shoulder 77 and the inclined rear face 80 of outer part 73. In use, when the forward end of nose 74 is first gripped by the tube and drawing begins, inner part 72 will initially be drawn forward relative to outer part 73, so compressing ring 47 axially but expanding it radially so that it firmly seals the upstream end of space 36. This forward relative motion ceases when spring 82 becomes fully compressed, when the two parts 72 and 73 are in the stable relative position in which they remain while drawing proceeds. Lubricant under pressure emerging from passage 81 now enters space 36 by way of drillings 79 and so ensures that space 36 remains filled with lubricant at pressure at all times.

The alternative floating plug of FIG. 6 is capable of operating without direct connection, as by the flexible tube 70 of FIG. 5, to a source of lubricant under pressure. Essentially it comprises a forward part 90, a middle part 91 and a rearward part 92. The forward part includes a conventional cylindrical nose 93, an inclined face 71 working like the same part in FIG. 5, and a central bore 94 including an enlarged cylinder part 95 from which a drilling 96 communicates with a region of ambient pressure. The forward ends 97 of a set of of pins 98 are anchored in the rearward end of forward part 90. The middle part 91 is formed with axial holes 99, in each of which one of the pins 98 is a sliding fit, and the rearmost end of a rod 100 is screw-threaded to engage with part 91 at 101. The forward end of rod 100 is formed as a piston 102, which moves within the cylinder 95, and a light spring 103 tends to urge the piston towards the forward end of that cylinder. The final and most rearward of the three members 92 is formed with a central venting drilling 104 and also, on its forward face, with an annular cavity 105 the outer wall of which is screw-threaded so as to engage with corresponding threads formed on the radially-outer faces of the four pins 98 at their rear ends. "O"-ring seal 47 is located between a shoulder 106 at the forward end of member 92, and an inclined face 107 on the rear end of member 91.

When nose 93 of member 90 is first gripped within the tube and surrounding die 1 and drawing begins, it may be ensured—for instance by having coated the inner surface of the undrawn tube copiously with lubricant—that space 36 is substantially filled with such lubricant. As the drawing speed rises towards normal working value—and therefore, as the speed of the tube relative to the plug rises also towards its working value—there is an increasing tendency for lubricant carried by the wall of the undrawn tube to be forced forwardly by hydrodynamic action past the "O"-ring 47 into space 36. This tends firstly to fill all empty spaces within that part of the plug lying downstream of the ring 47; that is to say the cylinder 95, the clearance between bore 94 and rod 100, and the disc-shaped clearance between members 90 and 91. Once all these spaces are filled, any expelled air having escaped through the slight sliding clearances between pins 98 and holes 99, the effect of any further lubricant forced forwards past ring 47 must be to raise the pressure of the mass of fluid lying beyond the ring. This raised pressure acts in opposite directions upon the right-hand face of piston 102 and the left-hand face 108 of member 91, and since as a result face 108 experiences the greater thrust member 91 is driven to the right relative to member 90, so compressing ring 47 axially but expanding it radially. In the steady state drawing condition the lubricant pressure within space 36, which includes at its forward end the nip 37, attains an above-ambient equilibrium value and the objective of the present invention is thus fulfilled. The equilibrium value depends upon the balance of several factors including the speed of the tube and the frictional capacity of its surface to carry lubricant past the ring 47, the viscosity of the lubricant, the reaction force with which the ring presses against the plug and tube wall and so resists the flow of lubricant, and the rate at which lubricant escapes from space 36 either through the nip 37, or in the upstream direction through the sliding clearances between pins 98 and holes 99, and so out through vent hole 104.

We claim:

1. A method for the plug drawing of a tube or other elongated stock of hollow section in a forwards direction through a first annular clearance defined as to its outer surface by a die and to its inner surface by a plug along a predetermined drawing axis, using a said plug comprising first and second rigid parts displaceable relative to each other in opposite first and second senses along said axis and also a deformable annular sealing member, and in which the inner periphery of said stock before said drawing exceeds the outer periphery of said plug, leaving a second annular clearance therebetween, said method comprising the steps firstly of providing a source of fluid with access to said second annular clearance, and secondly displacing said two parts in said first sense to cause said sealing member to deform whereby said sealing member closes the rearwardmost end of said second annular clearance between said plug and stock before drawing, whereby causing said annular space to be filled with and contain said fluid at above ambient pressure.

2. A method according to claim 1 including the step of restraining said first part from substantial movement in the said forwards direction by direct contact with and reaction against the inner surface of said stock, said reaction having at least a component in a direction parallel to said drawing axis.

* * * * *